US010345741B2

(12) United States Patent
Fujishima et al.

(10) Patent No.: US 10,345,741 B2
(45) Date of Patent: Jul. 9, 2019

(54) DEVELOPING DEVICE AND IMAGE FORMING APPARATUS INCLUDING SAME

(71) Applicant: KYOCERA Document Solutions Inc., Osaka (JP)

(72) Inventors: Masashi Fujishima, Osaka (JP); Norio Kubo, Osaka (JP); Junichi Nakagawa, Osaka (JP); Asami Sasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/890,702

(22) Filed: Feb. 7, 2018

(65) Prior Publication Data

US 2018/0253033 A1 Sep. 6, 2018

(30) Foreign Application Priority Data

Mar. 3, 2017 (JP) ..... 2017-040033

(51) Int. Cl.
*G03G 15/08* (2006.01)
*G03G 15/095* (2006.01)

(52) U.S. Cl.
CPC ..... *G03G 15/0891* (2013.01); *G03G 15/0849* (2013.01); *G03G 15/0853* (2013.01); *G03G 15/0865* (2013.01); *G03G 15/0893* (2013.01); *G03G 15/0889* (2013.01); *G03G 15/095* (2013.01); *G03G 2215/066* (2013.01); *G03G 2215/0607* (2013.01); *G03G 2215/083* (2013.01); *G03G 2215/0819* (2013.01); *G03G 2221/0005* (2013.01)

(58) Field of Classification Search
CPC ..... G03G 15/0893; G03G 15/0849–15/0855; G03G 2215/083
See application file for complete search history.

(56) References Cited

U.S. PATENT DOCUMENTS

2008/0025763 A1 1/2008 Suenami ..... 399/256
2008/0069580 A1* 3/2008 Oshige ..... G03G 15/0893 399/62
2012/0201573 A1* 8/2012 Watanabe ..... G03G 15/0853 399/256

(Continued)

FOREIGN PATENT DOCUMENTS

JP 2008-33109 A 2/2008
JP 2012-168232 A 9/2012

*Primary Examiner* — Sevan A Aydin
(74) *Attorney, Agent, or Firm* — Stein IP, LLC

(57) ABSTRACT

A developing device includes a developing container, first and second stirring-conveyance members, a developer carrier, a toner concentration sensor, a scraper, and a scraper attachment unit. The second stirring-conveyance member includes a rotation shaft, a first spiral blade to convey developer in an axial direction, and a second spiral blade to overlap a region where the first spiral blade is formed, which is opposite to the first spiral blade in phase, and lower than the first spiral blade in height in a radial direction. An absent region, where the second spiral blade does not exist, is formed in one pitch of the first spiral blade, the one pitch facing the toner concentration sensor. The scraper attachment unit is formed to extend, along a straight line passing through intersection points of the first and second spiral blades and parallel to the rotation shaft, into the absent region.

6 Claims, 5 Drawing Sheets

(56) References Cited

U.S. PATENT DOCUMENTS

| | | | | |
|---|---|---|---|---|
| 2013/0216257 | A1* | 8/2013 | Fujimura | G03G 15/0886 399/103 |
| 2014/0079415 | A1* | 3/2014 | Fukasawa | G03G 15/0891 399/27 |
| 2014/0161490 | A1* | 6/2014 | Yamane | G03G 15/0887 399/257 |
| 2014/0270817 | A1* | 9/2014 | Ikebata | G03G 15/0862 399/27 |
| 2014/0363179 | A1* | 12/2014 | Kusukawa | G03G 15/0889 399/27 |
| 2015/0078786 | A1* | 3/2015 | Tamaki | G03G 15/0889 399/254 |
| 2015/0078787 | A1* | 3/2015 | Gyotoku | G03G 15/0849 399/254 |
| 2015/0132027 | A1* | 5/2015 | Kashimoto | G03G 15/0891 399/254 |
| 2017/0023877 | A1* | 1/2017 | Kotani | G03G 15/0889 |
| 2017/0038705 | A1* | 2/2017 | Fukasawa | G03G 15/0891 |
| 2017/0168420 | A1* | 6/2017 | Fukasawa | G03G 15/0891 |

* cited by examiner

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2017-40033 filed on Mar. 3, 2017, the entire contents of which are incorporated herein by reference.

BACKGROUND

The present disclosure relates to a developing device for use in electro-photographic image forming apparatuses such as a copier, a printer, a facsimile machine, and a multifunction peripheral having these functions, and an image forming apparatus including such a developing device.

In image forming apparatuses, an electrostatic latent image formed on an image carrier such as a photosensitive drum or the like is developed by a developing device and visualized as a toner image. Examples of the developing device include one employing a two-component developing method, in which a two-component developer is used. In a developing device of this type, two-component developer (hereinafter, also referred to simply as developer) comprising toner and carrier is stored in a developing container, and there are arranged a developing roller, which supplies developer to an image carrier, and a stirring-conveyance member, which stirs and conveys developer in the developing container to supply the developer to the developing roller.

In a developing device employing the two-component developing method, in order to replenish toner of an amount consumed in development, it is necessary to measure toner concentration in developer by means of a toner concentration sensor disposed inside the developing container. For example, there has been proposed a developing device in which a toner concentration sensor is disposed, in a developer circulation path, on a side thereof where supply of the developer to a developing roller is performed, whereas a toner replenishment section is disposed on another side where supply of developer to the developing roller is not performed. With this configuration, the replenished toner reaches the toner concentration sensor after being sufficiently mixed with the developer inside the developing container, and accordingly the toner concentration in such a portion of the developer as is to be supplied to the developing roller can be directly detected. This helps replenish toner with further improved precision.

For maintenance of the detecting sensitivity of a toner concentration sensor, for example, there is known a method in which a scraper for cleaning the sensor surface (detection surface) of a toner concentration sensor is attached to such a portion of a stirring-conveyance member as opposes the toner concentration sensor.

On the other hand, there is known a stirring-conveyance member which includes a main conveyance blade (a first spiral blade) which conveys a developer in a first direction, which is a direction toward one side in an axial direction, along with rotation of a shaft member, and a sub conveyance blade (a second spiral blade) which produces a conveying effect in a second direction, which is a direction toward the other side in the axial direction, with respect to part of the developer, along with rotation of the shaft member. With this configuration, the sub conveyance blade causes convection in part of developer conveyed, and a stirring effect is promoted, with the conveying effect of the main spiral blade hardly inhibited.

SUMMARY

According to one aspect of the present disclosure, a developing device includes a developing container, a first stirring-conveyance member, a second stirring-conveyance member, a developer carrier, a toner concentration sensor, a scraper, and a scraper attachment unit. The developing container has a plurality of conveyance chambers including a first conveyance chamber and a second conveyance chamber arranged parallel to each other, a communication portion through which the first conveyance chamber and the second conveyance chamber communicate with each other at both end portions thereof in a longitudinal direction thereof. The developing container contains a two-component developer comprising carrier and toner. The first stirring-conveyance member stirs and conveys developer existing in the first conveyance chamber in an axial direction of a rotation shaft thereof. The second stirring-conveyance member stirs and conveys developer existing in the second conveyance chamber in a direction opposite to the direction in which the first stirring-conveyance member stirs and conveys developer. The second stirring-conveyance member has a rotation shaft which is rotatably supported inside the developing container, a first spiral blade which is formed on an outer circumferential surface of the rotation shaft and conveys the developer in an axial direction of the rotation shaft when the rotation shaft rotates, a second spiral blade which is formed on the outer circumferential surface of the rotation shaft so as to overlap a region in which the first spiral blade is formed, the second spiral blade being opposite to the first spiral blade in phase and lower than the first spiral blade in height in a radial direction; in the second stirring-conveyance member, an absent region, in which the second spiral blade does not exist, is formed in one pitch of the first spiral blade, the one pitch facing the toner concentration sensor. The developer carrier is rotatably supported on the developing container, and carries on a surface thereof developer from the first conveyance chamber or from the developer in the second conveyance chamber. The toner concentration sensor is disposed on an inner wall surface of the second conveyance chamber, and detects a toner concentration in developer. The scraper is flexible and attached to the second stirring-conveyance member, and cleans a detection surface of the toner concentration sensor with a free end thereof by rotating with the second stirring-conveyance member. The scraper attachment unit is formed to extend, along a straight line passing through intersection points of the first spiral blade and the second spiral blade and parallel to the rotation shaft, into the absent region.

Further features and specific advantages of the present disclosure will become apparent from the following descriptions of preferred embodiments.

DETAILED DESCRIPTION

Figure 1:
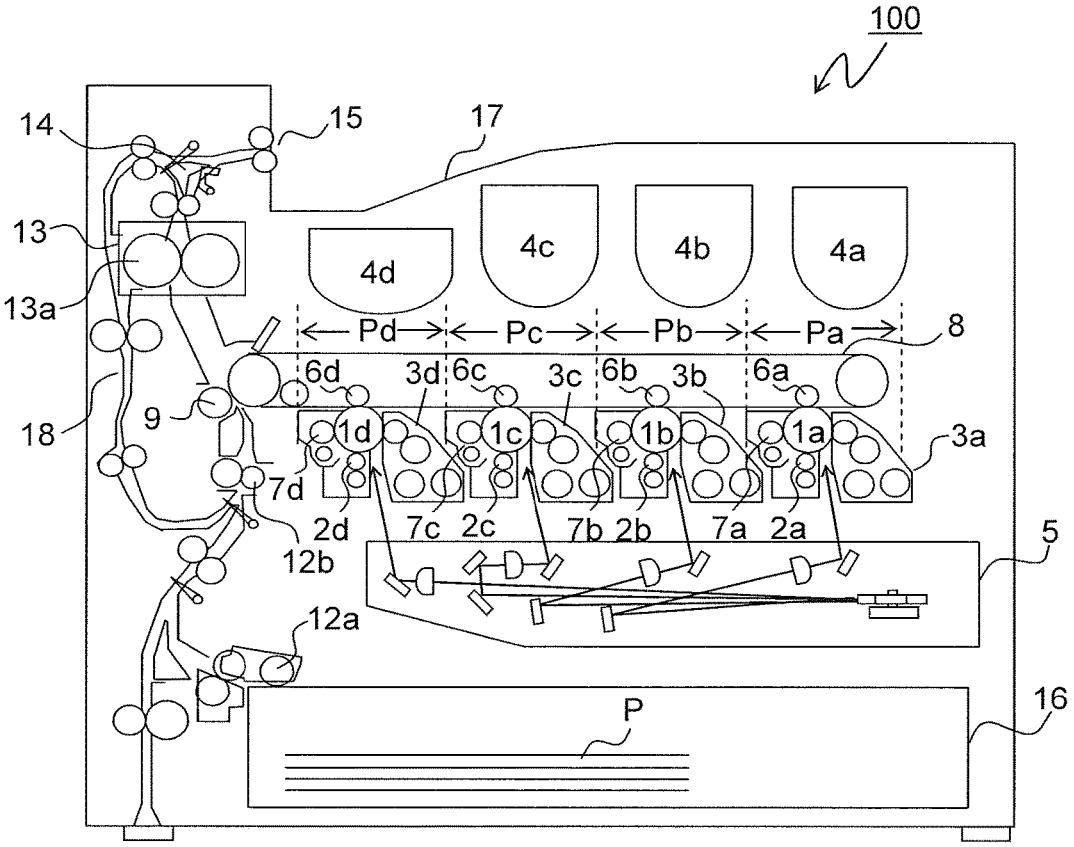
FIG. 1 is a schematic sectional view of a color printer incorporating a developing device of the present disclosure.

Hereinafter, embodiments of the present disclosure will be described with reference to the accompanying drawings. FIG. 1 is a schematic sectional view of an image forming apparatus incorporating developing devices 3*a* to 3*d* of the present disclosure, and the image forming apparatus shown herein is a tandem-type color printer. In a main body of the color printer 100, four image forming portions Pa, Pb, Pc, and Pd are arranged in this order from an upstream side (a right side in FIG. 1) in a conveyance direction. These image forming portions Pa to Pd are provided corresponding to images of four different colors (cyan, magenta, yellow, and black). The image forming portions Pa to Pd respectively forms cyan, magenta, yellow, and black images sequentially through charging, exposure, developing, and transfer processes.

The image forming portions Pa to Pd respectively include photosensitive drums 1*a*, 1*b*, 1*c*, and 1*d*, which carry visible images (toner images) of respective colors. There is further provided an intermediate transfer belt 8, which is rotatable clockwise in FIG. 1, to be adjacent to the image forming portions Pa to Pd.

When image data is fed from a host device such as a personal computer, first, chargers 2*a* to 2*d* charge surfaces of the photosensitive drums 1*a* to 1*d* uniformly. Then, an exposure device 5 irradiates the photosensitive drums 1*a* to 1*d* with light in accordance with the image data to form an electrostatic latent image on each of the photosensitive drums 1*a* to 1*d* in accordance with the image data. The developing devices 3*a* to 3*d* are each filled, by toner containers 4*a* to 4*d*, with a predetermined amount of two-component developer (which hereinafter may be referred to simply as developer) containing a toner of a corresponding one of the four colors of cyan, magenta, yellow and black, and toners contained in the developers are supplied by the developing devices 3*a* to 3*d*, and electrostatically adhere, to the photosensitive drums 1*a* to 1*d*. Thereby, toner images are formed in accordance with the electrostatic latent images formed by the exposure to the light emitted from the exposure device 5.

Then, by primary transfer rollers 6*a* to 6*d*, an electric field is applied at a predetermined transfer voltage between the primary transfer rollers 6*a*, 6*b*, 6*c*, and 6*d* and the photosensitive drums 1*a*, 1*b*, 1*c*, and 1*d*, respectively, and the toner images of cyan, magenta, yellow, and black on the photosensitive drums 1*a* to 1*d* are primarily transferred onto the intermediate transfer belt 8. After the primary transfer, residual toner and the like left on the surfaces of the photosensitive drums 1*a* to 1*d* are removed by the cleaning devices 7*a* to 7*d*.

Transfer paper sheets P onto each of which the toner images are to be secondarily transferred are accommodated in a sheet cassette 16 disposed in a lower portion inside the color printer 100. A transfer paper sheet P is conveyed at a predetermined timing via a sheet feeding roller 12*a* and a registration roller pair 12*b* to a nip portion (a secondary transfer nip portion) between a secondary transfer roller 9 provided adjacent to the intermediate transfer belt 8 and the intermediate transfer belt 8. The transfer paper sheet P is conveyed to a fixing portion 13 after the toner images are secondarily transferred thereonto.

To the transfer paper sheet P, which has been conveyed to the fixing portion 13, heat and pressure is applied by a fixing roller pair 13*a*, whereby the toner images are fixed on the surface of the transfer paper sheet P, and thus a predetermined full-color image is formed on a surface of the transfer paper sheet P. The transfer paper sheet P, on which the full-color image has been formed, is discharged onto a discharge tray 17 by a discharge roller pair 15 as it is (or after being directed by a branching unit 14 into a reverse conveyance path 18 and having an image formed on the other side, too).

Figure 2:
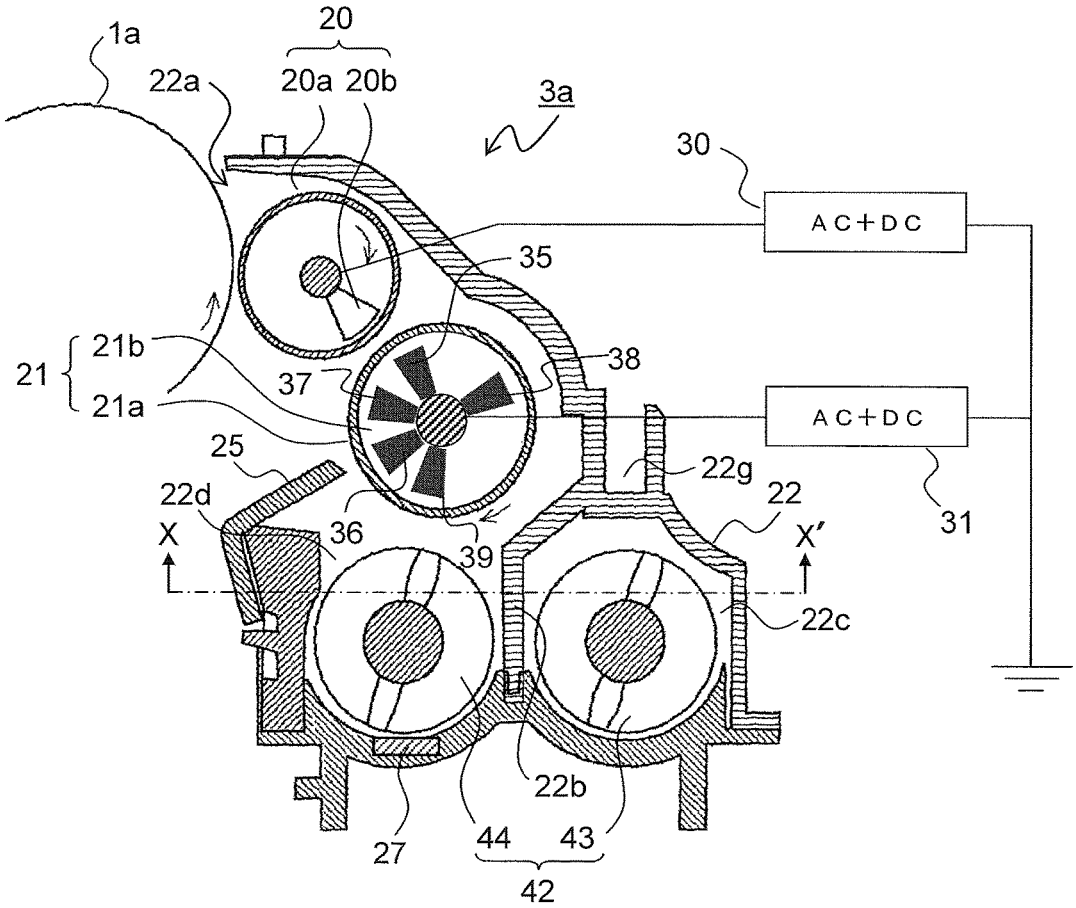
FIG. 2 is a side sectional view of a developing device according to an embodiment of the present disclosure.

FIG. 2 is a side sectional view showing a configuration of the developing device 3*a* according to an embodiment of the present disclosure incorporated in the color printer 100.

Here, only the developing device 3*a* arranged in the image forming portion Pa of FIG. 1 will be described, and the developing devices 3*b* to 3*d* arranged in the image forming portions Pb to Pd will not be described. This is because the developing devices 3*b* to 3*d* all have basically the same structure as the developing device 3*a*.

As shown in FIG. 2, the developing device 3*a* is provided with a developing container 22 in which a two-component developer is stored. The developing container 22 has an opening 22*a* formed therein through which a developing roller 20 is exposed toward the photosensitive drum 1*a*. The developing container 22 is divided by a partition portion 22*b* into a first conveyance chamber 22*c* and a second conveyance chamber 22*d*. In the first conveyance chamber 22*c* and the second conveyance chamber 22*d*, there are disposed a first spiral 43 and a second spiral 44, respectively, for mixing and stirring toner (positively chargeable toner) supplied from the toner container 4*a* with carrier to charge the toner, the first and second spirals 43 and 44 constituting a stirring-conveyance member 42.

Developer is stirred and conveyed in an axial direction, by the first spiral 43 and the second spiral 44 to circulate between the first and second conveyance chambers 22*c* and 22*d* through communication portions 22*e* and 22*f* (see FIG. 3) formed at both ends of the partition portion 22*b*. In the example illustrated in the figure, the developing container 22 extends obliquely to the upper left, and in the developing container 22, a magnetic roller 21 is disposed over the second spiral 44, and a developing roller 20 is disposed obliquely to the upper left of the magnetic roller 21 so as to face the magnetic roller 21. The developing roller 20 faces the photosensitive drum 1*a* at an opening-22*a* side (a left side in FIG. 2) of the developing container 22, and the magnetic roller 21 and the developing roller 20 rotate clockwise in FIG. 2.

The magnetic roller 21 includes a rotation sleeve 21*a*, which is not magnetic, and a stationary magnet body 21*b* disposed inside the rotation sleeve 21*a* and having a plurality of magnetic poles. In the present embodiment, the stationary magnet body 21*b* includes five poles, namely, a main pole 35, a regulation pole (a trimming magnetic pole) 36, a conveyance pole 37, a peeling pole 38, and a scooping pole 39. The magnetic roller 21 and the developing roller 20 face each other at a facing position (an opposing position) thereof with a predetermined gap therebetween.

Moreover, the developing container 22 has a trimming blade 25 attached thereto which extends along a longitudinal direction of the magnetic roller 21 (a direction perpendicular to the sheet on which FIG. 2 is drawn), and is positioned on an upstream side of the opposing position of the developing roller 20 and the magnetic roller 21 in the rotation direction of the magnetic roller 21 (the clockwise direction in FIG. 2). A slight clearance (gap) is formed between a leading end portion of the trimming blade 25 and a surface of the magnetic roller 21.

The developing roller 20 includes a developing sleeve 20*a*, which is not magnetic, and a developing roller-side magnetic pole 20*b* fixed inside the developing sleeve 20*a*. The developing roller-side magnetic pole 20*b* has a polarity different from that of the magnetic pole (the main pole) 35 of the stationary magnetic body 21*b*, to which the developing roller-side magnetic pole 20*b* is opposed.

The developing roller 20 has connected thereto a first power supply circuit 30, which applies a direct current voltage (hereinafter, referred to as Vslv (DC)) and an alternating current voltage (hereinafter, referred to as Vslv (AC)) to the developing roller 20. The magnetic roller 21 has connected thereto a second power supply circuit 31, which applies a direct current voltage (hereinafter, referred to as Vmag (DC)) and an alternating current voltage (hereinafter, referred to as Vmag (AC)) to the magnetic roller 21. The first power supply circuit 30 and the second power supply circuit 31 are connected to a common ground.

In a bottom of the second conveyance chamber 22*d*, there is disposed a toner concentration sensor 27 facing the second spiral 44. The toner concentration sensor 27 detects a toner-to-carrier ratio (T/C) in developer. Used as the toner concentration sensor 27 is, for example, a magnetic permeability sensor for detecting a magnetic permeability of two-component developer including toner and magnetic carrier inside the developing container 22. Based on a toner concentration detected by the toner concentration sensor 27, toner is replenished from the toner container 4*a* (see FIG. 1) into the developing container 22 through a developer replenishment port 22*g*.

As has been described above, toner is charged while developer is circulating inside the developing container 22 by being stirred and conveyed by the first spiral 43 and the second spiral 44, and developer is conveyed to the magnetic roller 21 by the second spiral 44. The trimming blade 25 is disposed opposite the regulation pole 36 of the stationary magnet body 21*b*, and thus, by using a non-magnetic body or a magnetic body having a polarity different from that of the regulation pole 36, an attracting magnetic field is generated in the clearance between the leading end of the trimming blade 25 and the rotation sleeve 21*a*.

By means of this magnetic field, a magnetic brush is formed between the trimming blade 25 and the rotation sleeve 21*a*. Then, the magnetic brush on the magnetic roller 21 has its layer thickness regulated by the trimming blade 25, and thereafter, moves to a position opposing the developing roller 20. Since an attracting magnetic field is given by the main pole 35 and the developing-roller-side magnetic pole 20*b* of the stationary magnet body 21*b*, the magnetic brush contacts the surface of the developing roller 20. Then, a thin toner layer is formed on the developing roller 20 based on a potential difference ΔV between Vmag (DC) applied to the magnetic roller 21 and Vslv (DC) applied to the developing roller 20, and a magnetic field.

The toner layer thickness on the developing roller 20, which is dependent on factors such as developer resistance, difference in rotation speed between the magnetic roller 21 and the developing roller 20, etc., is controllable by means of the potential difference ΔV. The larger the potential difference ΔV is made, the thicker the toner layer becomes on the developing roller 20, and the smaller the potential difference ΔV is made, the thinner the toner layer becomes on the developing roller 20. An appropriate range of the potential difference ΔV for development is typically on the order of 100 V to 350 V.

The thin toner layer formed on the developing roller 20 by the magnetic brush is conveyed by rotation of the developing roller 20 to where the photosensitive drum 1*a* faces the developing roller 20. Since Vslv (DC) and Vslv (AC) are applied to the developing roller 20, the toner is caused to fly by the potential difference from the photosensitive drum 1*a*, and with the toner, the electrostatic latent image formed on the photosensitive drum 1*a* is developed.

When the rotation sleeve 21*a* further rotates clockwise, then the magnetic brush is removed from the surface of the developing roller 20 due to a magnetic field in a horizontal direction (a roller circumferential direction) generated by the peeling pole 38, which is disposed adjacent to, and has a polarity different from that of, the main pole 35, and thereby the toner remaining on the developing roller 20 without being used for the development is collected onto the rotation sleeve 21*a*. When the rotation sleeve 21*a* further rotates, the peeling pole 38 and the scooping pole 39 of the stationary magnet body 21*b*, both having the same polarity, generate a repelling magnetic field, which causes the toner to leave the rotation sleeve 21*a* in the developing container 22. Then, after being stirred and conveyed by the second spiral 44 into a uniformly charged two-component developer having an appropriate toner concentration, the toner is again held on the rotation sleeve 21*a* by the scooping pole 39 to form a magnetic brush thereon, which is then conveyed to the trimming blade 25.

Figure 3:
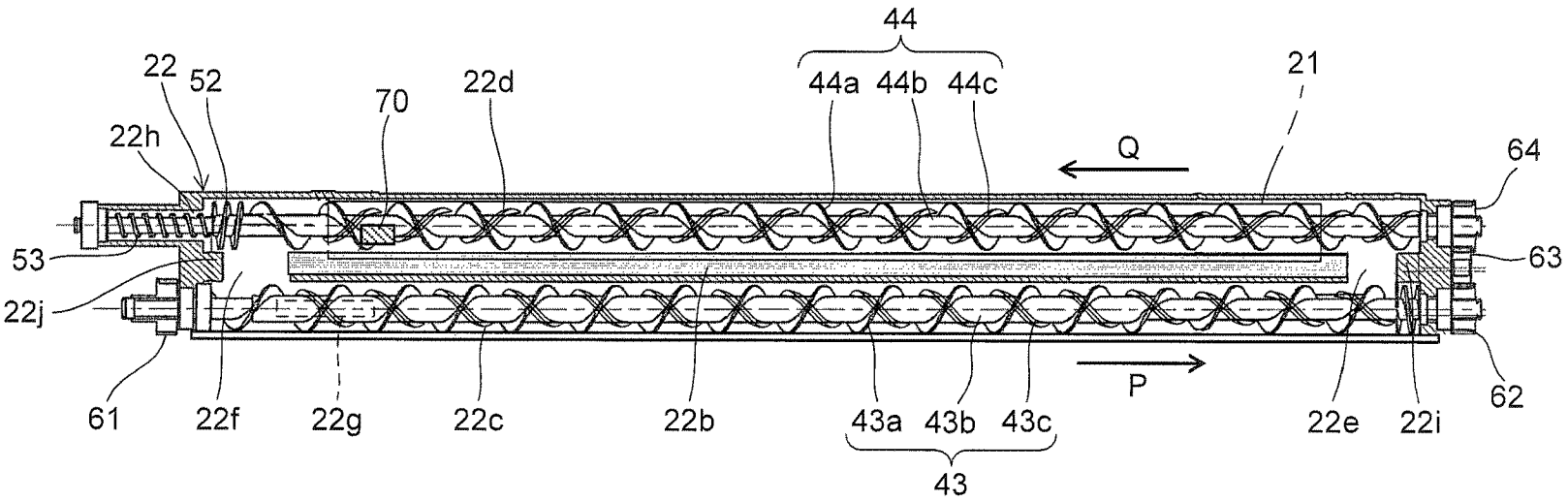
FIG. 3 is a plan sectional view illustrating a stirring portion of a developing device.

Next, a detailed description will be given of a configuration of a stirring portion of the developing device 3*a*. FIG. 3 is a plan sectional view (taken along line XX' of FIG. 2) illustrating the stirring portion of the developing device 3*a*.

In the developing container 22, as described above, the first conveyance chamber 22*c*, the second conveyance chamber 22*d*, the partition portion 22*b*, the upstream-side communication portion 22*e*, and the downstream-side communication portion 22*f* are formed, and in addition to these, there are further formed a developer replenishment port 22*g*, a developer discharge port 22*h*, an upstream-side wall portion 22*i*, and a downstream-side wall portion 22*j*. In the first conveyance chamber 22*c*, the left side in FIG. 3 is assumed to be the upstream side, and the right side in FIG. 3 is assumed to be the downstream side; in the second conveyance chamber 22*d*, the right side in FIG. 3 is assumed to be the upstream side and the left side in FIG. 3 is assumed to be the downstream side. Accordingly, the communication portions and the wall portions are denoted with "upstream-side" or "downstream-side" based on which side of the second conveyance chamber 22*d* they are located.

The partition portion 22*b* extends in a longitudinal direction of the developing container 22 to separate the first conveyance chamber 22*c* and the second conveyance chamber 22*d* from each other such that they are arranged parallel to each other. A right end portion of the partition portion 22*b* in its longitudinal direction, together with an inner wall portion of the upstream-side wall portion 22*i*, forms the upstream-side communication portion 22*e*. On the other hand, a left end portion of the partition portion 22*b* in its longitudinal direction, together with an inner wall portion of the downstream-side wall portion 22*j*, forms the downstream-side communication portion 22*f*. The developer circulates in the developing container 22 by sequentially passing through the first conveyance chamber 22*c*, the upstream-side communication portion 22*e*, the second conveyance chamber 22*d*, and the downstream-side communication portion 22*f*.

The developer replenishment port 22*g* is an opening through which to replenish fresh toner and carrier into the developing container 22 from a developer replenishing container (not shown) formed in an upper portion of the developing container 22, and the developer replenishing port 22*g* is formed on the upstream side (the left side in FIG. 3) of the first conveyance chamber 22*c*.

The developer discharge port 22*h* is an opening through which to discharge, from the first and second conveyance chambers 22*c* and 22*d*, surplus developer resulting from the replenishment of the developer, and the developer discharge port 22*h* is provided on the downstream side of the second conveyance chamber 22*d* to be continuous with the second conveyance chamber 22*d* in its longitudinal direction.

The first spiral 43 has a rotation shaft 43*b*, a first spiral blade 43*a* which is formed in a spiral shape at a constant pitch in an axial direction of the rotation shaft 43*b*, and a second spiral blade 43*c* which is formed in a spiral shape at the same pitch as the first spiral blade 43*a* in the axial direction of the rotation shaft 43*b* but is wound in an opposite direction (an opposite phase) with respect to the first spiral blade 43*a*. The first spiral blade 43*a* and the second spiral blade 43*c* extend to both end portions of the first conveyance chamber 22*c* in its longitudinal direction, such that they also face the upstream-side and downstream-side communication portions 22*e* and 22*f*. The rotation shaft 43*b* is rotatably supported on the upstream-side wall portion 22*i* and the downstream-side wall portion 22*j* of the developing container 22. Here, the first spiral blade 43*a* and the second spiral blade 43*c* are integrally formed with the rotation shaft 43*b* of a synthetic resin.

The second spiral 44 has a rotation shaft 44*b*, a first spiral blade 44*a* which is formed in a spiral shape at a constant pitch in an axial direction of the rotation shaft 44*b*, and a second spiral blade 44*c* which is formed in a spiral shape at the same pitch as the first spiral blade 44*a* in the axial direction of the rotation shaft 44*b* but is wound in an opposite direction (opposite phase) with respect to the first spiral blade 44*a*. The first spiral blade 44*a* is wound at the same pitch as, but in an opposite direction (opposite phase) with respect to, the first spiral blade 43*a* of the first spiral 43. The first spiral blade 44*a* and the second spiral blade 44*c* have a length equal to or longer than that of the magnetic roller 21 in its axial direction, and also extend to positions where they face the upstream-side communication portion 22*e*. The rotation shaft 44*b* is disposed parallel to the rotation shaft 43*b*, and rotatably supported on the upstream-side wall portion 22*i* and the downstream-side wall portion 22*j* of the developing container 22. The first spiral blade 44*a* and the second spiral blade 44*c* are formed to cross each other at two intersection points 47 (see FIG. 5) separated from each other by an angle of 180° in each of their turns around the rotation shaft 44*b*.

Furthermore, in addition to the spiral blade 44*a* and the second blade 44*c*, a regulation portion 52 and a discharge blade 53 are integrally formed with the rotation shaft 44*b* of the second spiral 44. Furthermore, the rotation shaft 44*b* has a scraper 70 attached thereto, at a portion thereof opposing the toner concentration sensor 27 (see FIG. 2). The scraper 70 is fixed to a scraper attachment unit 54 (see FIG. 5), which is integrally formed with the rotation shaft 44*b*. Detailed configurations of the first spiral blade 44*a*, the second spiral blade 44*c*, and the scraper attachment unit 54 will be described later.

The regulation portion 52 is provided to block developer conveyed to the downstream side in the second conveyance chamber 22*d*, and also to convey surplus developer to the developer discharge portion 22*h* when the amount of developer exceeds a predetermined amount. The regulation portion 52 comprises a spiral blade which is wound around the rotation shaft 44*b*, in an opposite direction (opposite phase) with respect to the first spiral blade 44*a* provided on the rotation shaft 44*b*, at a pitch smaller than that of the first spiral blade 44*a*, and which has substantially the same outer diameter as the first spiral blade 44*a*. Furthermore, the regulation portion 52 is disposed such that a predetermined clearance is provided between an inner wall portion of the developing container 22 including the downstream-side wall portion 22*j* and an outer circumference portion of the regulation portion 52. Through this clearance, surplus developer is discharged into the developer discharge port 22*h*.

The rotation shaft 44*b* extends into the developer discharge port 22*h*. On such a portion of the rotation shaft 44*b* as is located in the developer discharge port 22*h*, there is provided a discharge blade 53. The discharge blade 53 comprises a spiral blade winding in the same direction (same phase) as the first spiral blade 44*a* but at a pitch that is smaller than that of the second spiral blade 44*a*, and has a smaller outer diameter than the first spiral blade 44*a*. Accordingly, when the rotation shaft 44*b* rotates, the discharge blade 53 also rotates with it, and the surplus developer conveyed over the regulation portion 52 into the developer discharge port 22*h* is conveyed to the left side in FIG. 3, to be then discharged to outside the developing container 22.

On an outer wall of the developing container 22, gears 61 to 64 are arranged. The gears 61 and 62 are fixed to the rotation shaft 43*b*, the gear 64 is fixed to the rotation shaft 44*b*, and the gear 63 is rotatably held on the developing container 22, and meshes with the gears 62 and 64.

With the first spiral 43 configured as described above, where the first spiral blade 43*a* is provided on the outer circumferential surface of the rotation shaft 43*b*, the rotation of the rotation shaft 43*b* causes the first spiral blade 43*a* to convey, while stirring, the developer in a first direction (arrow P direction in FIG. 3). Furthermore, on the outer circumferential surface of the rotation shaft 43*b*, the second spiral blade 43*c*, which is opposite in phase to, and has a smaller diameter than, the first spiral blade 43*a*, is provided such that each turn thereof is located in one pitch (a space between adjacent turns) of the first spiral blade 43*a*. The second spiral blade 43*c* is caused by the rotation of the rotation shaft 43*b* to produce a conveyance effect with respect to developer in a second direction (arrow Q direction), which is opposite to the first direction.

Further, with the second spiral 44 configured as described above, where the first spiral blade 44*a* is provided on the outer circumferential surface of the rotation shaft 44*b*, the first spiral blade 44*a* is caused by the rotation of the rotation shaft 44*b* to convey, while stirring, developer in a first direction (arrow Q direction in FIG. 3). Furthermore, on the outer circumferential surface of the rotation shaft 44*b*, the second spiral blade 44*c*, which is opposite in phase to, and has a smaller diameter than, the first spiral blade 44*a*, is provided such that each turn thereof is located in one pitch (a space between adjacent turns) of the first spiral blade 44*a*. The second spiral blade 44*c* is caused by the rotation of the rotation shaft 44*b* to produce a conveyance effect with respect to developer in a second direction (arrow P direction), which is opposite to the first direction.

The second spiral blades 43*c* and 44*c*, being located interior to outer circumferential edges of the first spiral blades 43*a* and 44*a*, respectively, in the radial direction, the conveyance effects in the second directions produced by the rotations of the second spiral blades 43*c* and 44*c* are produced with respect to part of developer existing near the rotation shafts 43*b* and 44*b*, respectively. Thus, the conveyance effects do not inhibit the conveyance effects in the first directions produced by the first spiral blades 43*a* and 44*a*.

Thus, by using the second spiral blades 43*c* and 44*c* to produce conveyance effects in directions (the second directions) which are opposite to the conveyance directions (the first directions) of developer produced by the first spiral blades 43*a* and 44*a*, convection of the developer is produced in pitches of the first spiral blades 43*a* and 44*a*, and this promotes the stirring of the developer in the pitches of the first spiral blades 43*a* and 44*a* without inhibiting powder (developer) conveyance effects of the first spiral blades 43*a* and 44*a*. Accordingly, it is possible not only to quickly and sufficiently mix the fresh toner and carrier replenished through the developer replenishment port 22*g* with two-component developer existing in the first conveyance chamber 22*c* and the second conveyance chamber 22*d*, but also to effectively prevent reduction of developer conveyance speed in the first conveyance chamber 22*c* and the second conveyance chamber 22*d*.

Figure 4:
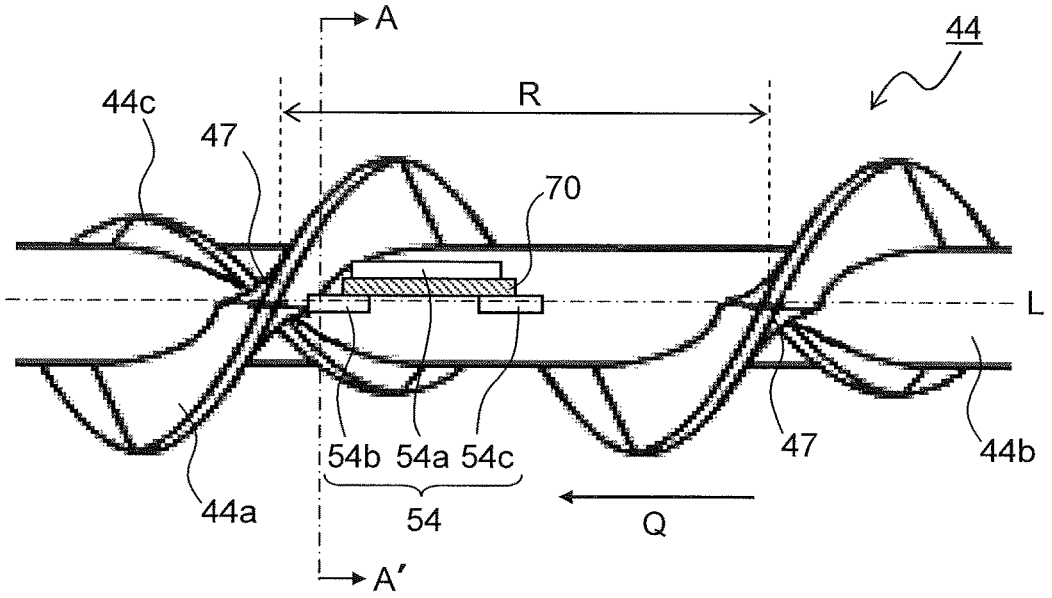
FIG. 4 is a side view of a second spiral used in the developing device of the present embodiment, illustrating a portion thereof near a scraper, as viewed from a direction of a leading end of the scraper.
Figure 5:
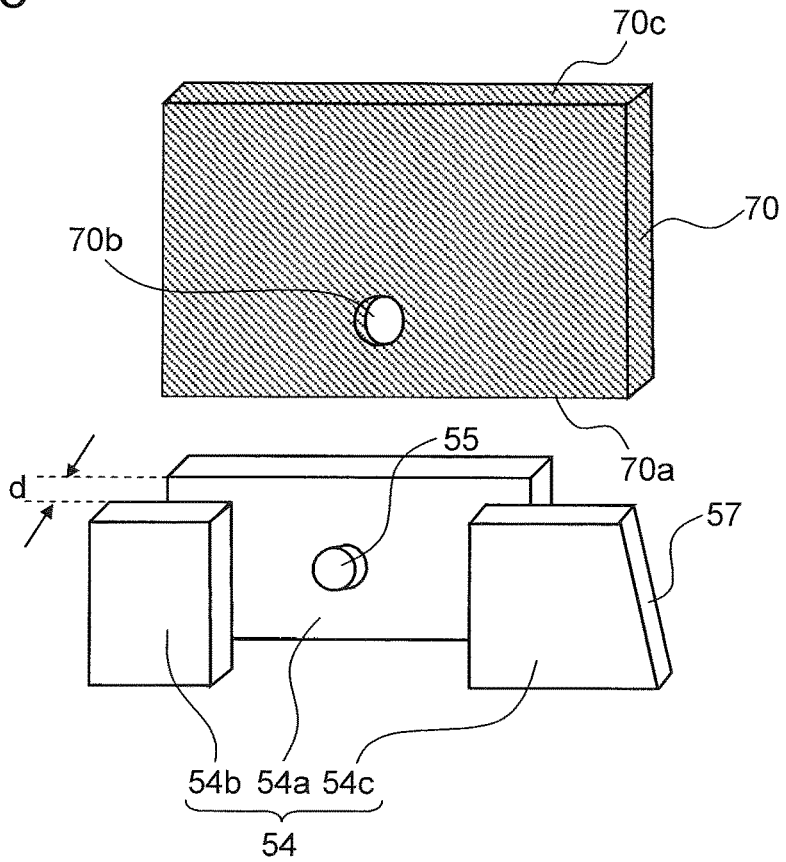
FIG. 5 is a perspective view of the scraper and a scraper attachment unit, with the scraper detached from the scraper attachment unit.
Figure 6:
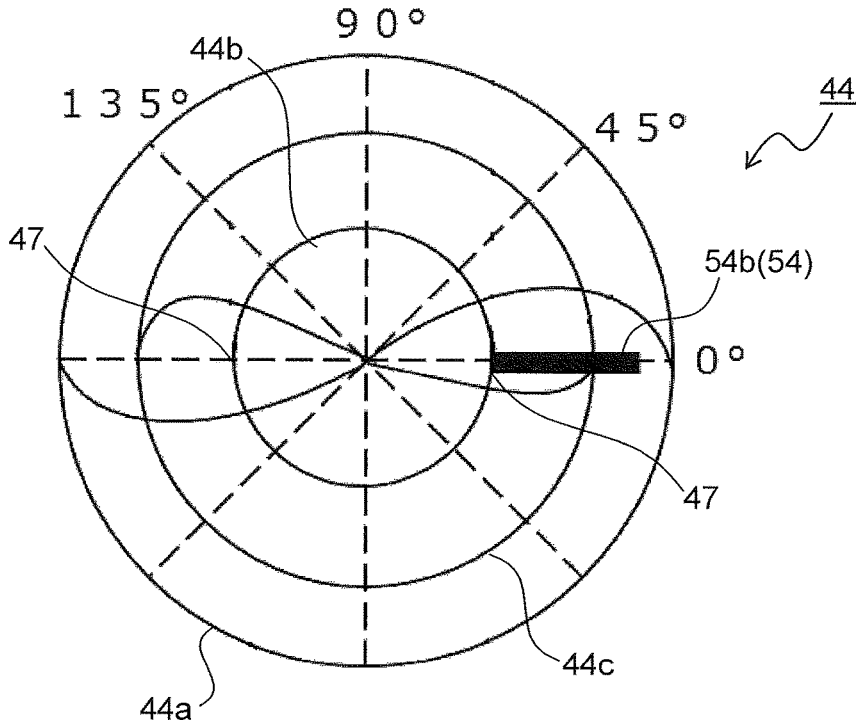
FIG. 6 is a sectional view of the second spiral used in the developing device of the present embodiment, taken by cutting the second spiral near the scraper along a radial direction.

FIG. 4 is a side view of the second spiral 44 used in the developing device 3*a* of the present embodiment, illustrating a portion thereof near the scraper 70, FIG. 5 is a perspective view of the scraper 70 and the scraper attachment unit 54, with the scraper 70 detached from the scraper attachment unit 54, and FIG. 6 is a sectional view (taken along line AA' in FIG. 4) of the second spiral 44 used in the developing device 3*a* of the present embodiment, obtained by cutting the second spiral 44 along a radial direction at a position near the scraper 70. As illustrated in FIG. 4, in the second spiral 44, there is formed an absent region R, which is one pitch of the first blade 44*a* where the second spiral blade 44*c* does not exist. In the absent region R, the scraper attachment unit 54 is formed, to which the scraper 70 is to be attached.

The scraper attachment unit 54 is constituted by an attachment member 54*a* which is provided to project substantially vertically in a radial direction from the outer circumferential surface of the rotation shaft 44*b*, and a first support member 54*b* and a second support member 54*c* which are provided to project substantially vertically in the radial direction from the outer circumferential surface of the rotation shaft 44*b* so as to face both end portions of the attachment member 54*a* in its width direction (the left-right direction in FIG. 4). The attachment member 54*a*, the first support member 54*b*, and the second support member 54*c* are formed along a straight line L which passes through the intersection points 47 (at position 0° in FIG. 6) of the first spiral blade 44*a* and the second spiral blade 44*c* and which is parallel to the rotation shaft 44*b*.

The attachment member 54*a* is formed in a substantially rectangular shape in a side view, and has formed therein a positioning boss 55 which is to be inserted into a positioning hole 70*b* which is formed near a base end portion 70*a* of the scraper 70.

The first support member 54*b* is formed in a substantially rectangular shape in a side view and disposed opposite a downstream-side end portion of the attachment member 54*a*. The second support member 54*c* is disposed on an upstream side (the right side in FIG. 5) of the first support member 54*b* with respect to a developer conveyance direction to be spaced from the first support member 54*b* by a predetermined distance, opposing an upstream-side end portion of the attachment member 54*a*. The second support member 54*c* is formed in a trapezoidal shape in a side view, with a side 57 thereof, which is a side on the upstream side with respect to the developer conveyance direction, inclined toward the downstream side toward a leading end thereof. A gap (clearance) d between the attachment member 54*a* and the first support member 54*b*, and between the attachment member 54*a* and the second support member 54*c*, is substantially equal to the dimension of the scraper 70 in its thickness direction. The first support member 54*b* and the second support member 54*c* are disposed so as to face a surface (a lower surface in FIG. 4) of the attachment member 54*c* on a downstream side with respect to a rotation direction of the second spiral 44 (an up to down direction in FIG. 4).

The scraper 70 has the base end portion 70*a* thereof fixed to the attachment member 54*a*, and is attached so as to be substantially parallel to the rotation shaft 44*b* by having its both end portions in its width direction (the axial direction) respectively held between the attachment member 54*a* and the first support member 54*b* and between the attachment member 54*a* and the second support member 54*c*. By the scraper 70 rotating along with the rotation of the rotation shaft 44*b*, a detection surface (a surface facing the second spiral 44) of the toner concentration sensor 27 (see FIG. 2) is rubbed and cleaned by a leading end portion 70*c* of the scraper 70, and fresh developer is sent to near the detection surface. Used as the scraper 70 is, for example, a member obtained by laying a fiber sheet such as a felt sheet, a nonwoven cloth sheet, or the like on a surface of a substrate on the downstream side with respect to the rotation direction, the substrate being made of a flexible film such as a PET film, for example.

In the present embodiment, in the absent region R, where the second spiral blade 44*c* does not exist, the scraper attachment unit 54 is formed along the straight line L, which passes through the intersection points 47 of the first spiral blade 44*a* and the second spiral blade 44*c*, and is parallel to the rotation shaft 44*b*. With this configuration, since the second spiral blade 44*c* does not exist in the portion where the scraper 70 is provided, compression of the developer near the toner condensation sensor 27 is alleviated. As a result, increase in carrier density attributable to compression of the developer is also reduced, and this helps approximate detection results of the toner concentration sensor 27 to actual toner concentrations. Accordingly, it is possible to effectively reduce occurrence of fogging due to excessive supply of toner.

Furthermore, the scraper attachment unit 54 can be formed at any position in the absent area R in the axial direction of the rotation shaft 44*b*, but if it is formed close to an upstream side (the right side in FIG. 4) of the absent region R with respect to the developer conveyance direction, an increased amount of developer will flow to near the scraper 70, which makes the leading end portion of the scraper 70 liable to be distorted, and then, the scraper 70 comes to rub the detection surface of the toner concentration sensor 27 with a weaker force. As a result, a toner concentration detected by the toner concentration sensor 27 may become higher than the actual toner concentration, and the toner concentration in the developing container 22 may be reduced. To prevent this inconvenience, it is preferable, as illustrated in FIG. 4, to form the scraper attachment unit 54 to extend, starting from one of the intersection points 47 that is on the downstream side (the left side in FIG. 4) with respect to the developer conveyance direction, to the upstream side (toward the absent region R) of the developer conveyance direction (arrow Q direction) in the second conveyance chamber 22*d*.

Figure 7:
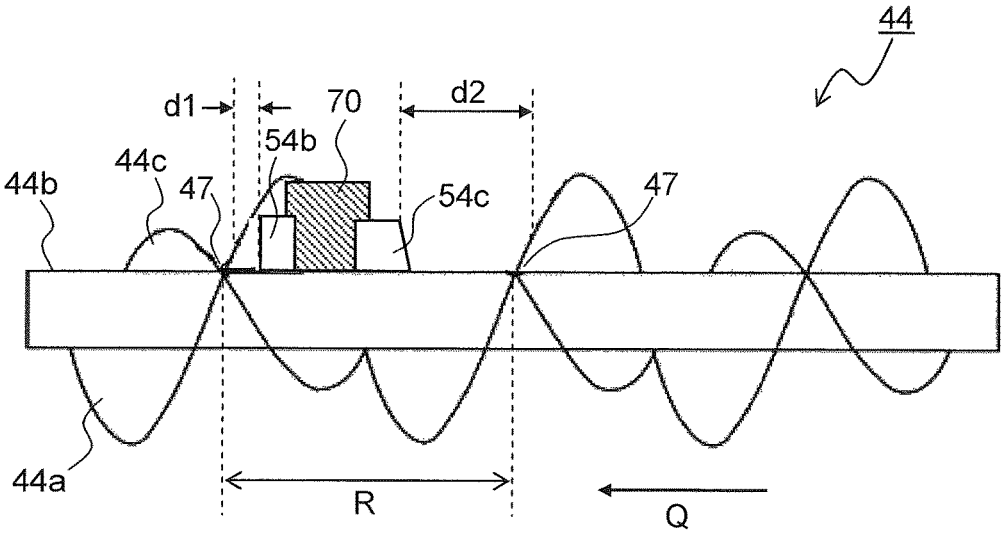
FIG. 7 is a side view of the second spiral, schematically illustrating a portion of the second spiral near the scraper, as viewed from a direction of a surface of the scraper.

FIG. 7 is a side view schematically illustrating a portion of the second spiral 44 near the scraper 70 used in the developing device 3*a* of the present embodiment. Note that FIG. 7 illustrates what is viewed from the side of a surface of the scraper 70 (from the lower side in FIG. 4), with the rotation shaft 44*b* having been rotated by an angle of 45° from the state shown in FIG. 4.

When the second spiral 44 is rotated, pressure from developer is applied to the scraper 70, and this may sometimes cause the scraper 70 to come off from the scraper attachment unit 54. To prevent this, as illustrated in FIG. 7, a clearance d1 is provided between an upper end portion of the first support member 54*b* and a first spiral blade 44*a*. Further, a clearance d2 is provided between an upper end portion of the second support member 54*c* and the first spiral blade 44*a*.

With this configuration, developer pushed by the scraper 70 when the second spiral 44 is rotated is allowed to escape through the clearances d1 and d2 to the upstream side of the rotation direction, and thus the pressure from the developer applied to the scraper 70 is reduced. This helps reduce occurrence of coming off of the scraper 70 from the attachment member 54*a*.

Also, in the present embodiment, the side 57 (see FIG. 5) of the second support member 54*c* on the upstream side (the right side in FIG. 7) with respect to the developer conveyance direction is inclined toward the downstream side toward the leading end of the second support member 54*c*. Thereby, it is possible to widen the clearance d2 between the upper end portion of the second support member 54*c* and the first spiral blade 44*a*, and thus to further reduce the pressure applied from the developer to the scraper 70.

It should be understood that the present disclosure is not limited to the above embodiments, and various modifications are possible within the scope of the present disclosure. For example, the present disclosure is not limited to the developing device illustrated in FIG. 2 provided with the magnetic roller 21 and the developing roller 20, but it is applicable also to various developing devices which use a two-component developer containing a toner and a carrier. For example, the above embodiments have dealt with a developing device of a two-shaft conveyance type including a first conveyance chamber 22*c* and a second conveyance chamber 22*d* arranged parallel to each other, but the present disclosure is applicable also to a developing device of a three-shaft conveyance type provided with a collection conveyance chamber which collects developer ripped off from a magnetic roller 21 and conveys the developer into a second conveyance chamber 22*d*. Further, the above embodiments have dealt with a developing device in which fresh toner and carrier are replenished and surplus developer is discharged, but the present disclosure is applicable also to a developing device in which toner is replenished only by an amount equal to the toner consumed in printing.

Further, in the above embodiments, the toner concentration sensor 27 is disposed on the upstream side of the regulation portion 52 with respect to the developer conveyance direction in the second conveyance chamber 22*d*, but the arrangement of the toner concentration sensor 27 is not limited to this, and it may be disposed in the first conveyance chamber 22*c*, for example. In that case, it is necessary to provide the scraper 70 as well, which cleans the detection surface of the toner concentration sensor 27, on the first spiral 43 side, and thus, the absent region R and the scraper attachment unit 54 should be disposed on the rotation shaft 43*b* of the first spiral 43 at positions opposing the toner concentration sensor 27.

Further, the present disclosure is applicable not only to the tandem type color printer as illustrated in FIG. 1, but also to various image forming apparatuses using two-component developing method, such as digital or analog monochrome copiers, monochrome printers, color copiers, and facsimiles. Hereinafter, the effects of the present disclosure will be described more specifically using examples of the present disclosure.

Example 1

Research was conducted to find out a relationship between occurrence of a foggy image and toner concentration in the developing devices 3*a* to 3*d*, with the scraper attachment unit 54 disposed at various positions in the circumferential direction. Examinations were conducted with the cyan image forming unit Pa including the photosensitive drum 1*a* and the developing device 3*a*.

Tests were conducted with developing devices 3*a*, having their respective scraper attachment units 54 disposed on their respective second spirals 44 at circumferential positions respectively at angles of 0°, 45°, 90°, and 135°, each filled with developer containing positively chargeable toner having an average particle diameter of 6.8 μm and ferrite carrier. These developing devices 3*a* were installed in a test machine, and a test image with a printing rate of 5% was printed on 100K sheets (100,000 sheets) under low-temperature, low-humidity conditions (10° C., 10%), and a reflective densitometer was used to measure densities (FD; fog density) in white areas. When a measured density was equal to or higher than a target value (0.01), fogging was judged to have occurred. Further, by sampling the developer in each of the developing devices 3*a* to measure toner concentration therein, and comparisons were made with respect to differences between a target value (8%) and measured toner concentrations. The results are shown in Table 1.

In each of the developing devices 3*a*, in the second spiral 44, the first spiral blade 44*a* had an outer diameter of 17 mm (a radial direction height of 5.5 mm) and a pitch of 30 mm, and the second spiral blade 44*c* had an outer diameter of 10 mm (a radial direction height of 2.0 mm) and a pitch of 30 mm. The regulation portion 52 was constituted by two pieces of spiral blades wound at a pitch of 5 mm in opposite directions (opposite phases) and having an outer diameter of 12 mm, and the clearance between the regulation portion 52 and the second conveyance chamber 22*d* was 1.5 mm. The discharge blade 53 was a spiral blade having an outside diameter of 8 mm, a pitch of 5 mm, and the clearance between the discharge blade 53 and the developer discharge port 22*h* was 1 mm.

TABLE 1

| | Position of Scraper Attachment Unit in Circumferential Direction | | | |
|---|---|---|---|---|
| | 0° | 45° | 90° | 135° |
| FD | 0.006 | 0.016 | 0.021 | 0.014 |
| Toner Concentration [%] | 8.2 | 11.3 | 12.6 | 10.7 |

As is clear from Table 1, with the developing device 3*a* (the present disclosure) in which the circumferential position of the scraper attachment unit 54 was the position at the angle of 0° in FIG. 6, FD=0.006 (<0.01) held, and fogging did not occur. In addition, the toner concentration inside the developing device 3*a* was close to the target value of 8%.

In contrast, with the other developing devices 3*a* (comparative examples) in which the circumferential positions of the respective scraper attachment units 54 were the positions at the angles of 45°, 90°, and 135° in FIG. 6, FD>0.01 held, and fogging occurred. In addition, the toner concentrations in these developing devices 3*a* greatly exceeded the target value of 8%. This can be thought to be because, in each of the cases where the scraper attachment unit 54 was disposed at positions other than the position at the angle of 0°, the scraper 70 compressed developer existing near the toner concentration sensor 27 to raise the carrier density, due to which the toner concentration was detected to be lower than it actually was, resulting in excessive replenishment of toner.

Example 2

Research was conducted to find out a relationship between image density and toner concentration in the developing devices 3*a* to 3*d* with the scraper attachment unit 54 disposed at various positions in the axial direction. Note that, like in Example 1, tests were conducted here with the cyan image forming unit Pa including the photosensitive drum 1*a* and the developing device 3*a*.

The tests were conducted with developing devices 3*a* having their respective scraper attachment units 54 disposed on their respective second spirals 44 at a common circumferential position at the angle of 0° in FIG. 6, but respectively at axial positions on a downstream side of the absent region R (the position in FIG. 4), in a center of the absent region R, and on an upstream side of the absent region R, with respect to the developer conveyance direction, each filled with developer containing positively chargeable toner having an average particle diameter of 6.8 μm and ferrite carrier. These developing devices 3*a* were installed in a test machine, and a test image with a printing rate of 5% was printed on 100K sheets (100,000 sheets) under low-temperature, low-humidity conditions (10° C., 10%), and a reflective densitometer was used to measure image densities (ID; image density). When a measured density was lower than a target value (1.40), the image density was judged to have been reduced. Further, by sampling the developer in each of the developing devices 3*a* to measure toner concentration therein, and differences between a target value (8%) and measured toner concentrations were compared with each other. The measurement results are shown in Table 2.

TABLE 2

| | Position of Scraper Attachment Unit in Axial Direction | | |
|---|---|---|---|
| | Downstream Side | Center | Upstream Side |
| ID | 1.42 | 1.38 | 1.30 |
| Toner Concentration [%] | 8.2 | 7.4 | 7.0 |

As is clear from Table 2, with the developing device 3*a* in which the position of the scraper attachment unit 54 in the axial direction was on the downstream side of the absent region R, ID=1.42 (>1.40) held, and reduction in image density did not occur. In addition, the toner concentration in the developing device 3*a* was close to the target value of 8%. On the other hand, in the other developing devices 3*a* in which the positions of the respective scraper attachment units 54 in the axial directions were respectively in the center portion and on the upstream side of the absent region R, IC=1.38 (<1.40) and IC=1.30 (<1.40) held, respectively, and reduction in image density occurred. In addition, the toner concentrations in these developing devices 3*a* were lower than the target value of 8%.

This can be thought to be because, as the position of the scraper attachment unit 54 in the axial direction was on a further upstream side, the leading end portion of the scraper 70 received more pressure from developer to be distorted, due to which toner concentration was detected to be higher than it actually was, resulting in insufficient replenishment of toner.

Example 3

Research was conducted to find out a relationship between presence or absence of a clearance between the first and second support members 54*b* and 54*c* of the scraper attachment unit 54 and the first spiral blade 44*a* and coming off of the scraper 70. Note that, like in Example 1, tests were conducted with the cyan image forming unit Pa including the photosensitive drum 1*a* and the developing device 3*a*.

The tests were conducted with developing devices 3*a* (No. 1 to 8), which were different from each other in presence or absence of a clearance between the first support member 54*b* and the lower and upper end portions of the first spiral blade 44*a* and presence or absence of a clearance between the second support member 54*c* and the first spiral blade 44*a*, each filled with developer containing positively chargeable toner having an average particle diameter of 6.8 μm and ferrite carrier. These developing devices 3*a* were installed in a test machine, and a test image with a printing rate of 5% was printed on 100K sheets (100,000 sheets) under room-temperature, room-humidity conditions (23° C., 55%), and observation was conducted on coming off of the scraper 70. The measurement results are shown in Table 3.

TABLE 3

| | 1st Support Member | | 2nd Support Member Scraper | |
|---|---|---|---|---|
| No. | Lower Clearance | Upper Clearance | Clearance against 1st Spiral Blade | Coming Off |
| 1 | Formed | Formed | Formed | Not Occurred |
| 2 | | | Not formed | Occurred |
| 3 | | Not formed | Formed | Occurred |
| 4 | | | Not formed | Occurred |
| 5 | Not Formed | Formed | Formed | Not Occurred |
| 6 | | | Not formed | Occurred |
| 7 | | Not formed | Formed | Occurred |
| 8 | | | Not formed | Occurred |

As is clear from Table 3, in the developing devices 3*a* (No. 1 and No. 5) in which a clearance was provided between the first support member 54*b* and the upper end portion of the first spiral blade 44*a* and a clearance was also provided between the second support member 54*c* and the first spiral blade 44*a*, coming off of the scraper 70 did not occur after the printing on the 100K sheets. On the other hand, in the developing devices 3*a* (No. 3, No. 4, No. 7, and No. 8) in which no clearance was provided between the first support member 54*b* and the upper end portion of the first spiral blade 44*a*, and in the developing devices 3*a* (No. 2 and No. 6) in which no clearance was provided between the second support member 54*c* and the first spiral blade 44*a*, coming off of the scraper 70 occurred after the printing on the 100K sheets.

This can be thought to be because, in the cases where no clearance was provided between the first support member 54*b* and the upper end portion of the first spiral blade 44*a*, or in the cases where no clearance was provided between the second support member 54*c* and the first spiral blade 44*a*, there was no place for the developer pushed by the scraper 70 to escape into, and thus the pressure from the developer worked strongly on the scraper 70. Note that it was ascertained that the presence or absence of a clearance between the first support member 54*b* and the lower end portion of the first spiral blade 44*a* has nothing to do with the coming off of the scraper 70.

The present disclosure can be used in developing devices having a toner concentration sensor which detects a toner concentration in a two-component developer existing in a developing container and a scraper which cleans the detection surface of the toner concentration sensor by rotating together with a stirring-conveyance member. By using the present disclosure, it is possible to detect a toner concentration in a developing container with high accuracy, and to provide a developing device capable of reducing the occurrence of fogging due to excessive supply of toner.

What is claimed is:

1. A developing device comprising:

a developing container which has a plurality of conveyance chambers including a first conveyance chamber and a second conveyance chamber arranged parallel to each other, and a communication portion through which the first conveyance chamber and the second conveyance chamber communicate with each other at both end portions thereof in a longitudinal direction thereof, the developing container containing two-component developer comprising carrier and toner;

a first stirring-conveyance member which stirs and conveys developer existing in the first conveyance chamber in an axial direction of a rotation shaft thereof;

a second stirring-conveyance member which stirs and conveys developer existing in the second conveyance chamber in a direction opposite to the direction in which the first stirring-conveyance member conveys developer;

a developer carrier which is rotatably supported on the developing container, and carries on a surface thereof developer from the first conveyance chamber or from the second conveyance chamber;

a toner concentration sensor which is disposed on an inner wall surface of the second conveyance chamber, and detects a toner concentration in developer; and a scraper which is flexible and attached to the second stirring-conveyance member, and cleans a detection surface of the toner concentration sensor with a free end thereof by rotating with the second stirring-conveyance member, wherein the second stirring-conveyance member has a rotation shaft which is rotatably supported inside the developing container;

a first spiral blade which is formed on an outer circumferential surface of the rotation shaft, and conveys developer in an axial direction of the rotation shaft when the rotation shaft rotates;

a second spiral blade which is formed on the outer circumferential surface of the rotation shaft so as to overlap a region in which the first spiral blade is formed, the second spiral blade being opposite to the first spiral blade in phase and lower than the first spiral blade in height in a radial direction;

an absent region which is formed in one pitch of the first spiral blade, the one pitch facing the toner concentration sensor, and in which the second spiral blade does not exist; and a scraper attachment unit which is formed to extend, along a straight line passing through intersection points of the first spiral blade and the second spiral blade and parallel to the rotation shaft, into the absent region, the scraper being fixed to the scraper attachment unit, and the scraper attachment unit is formed starting from a downstream-side one of the intersection points of the first spiral blade and the second spiral blade with respect to a developer conveyance direction in the second conveyance chamber.

2. An image forming apparatus comprising the developing device of claim 1.

3. A developing device comprising:

a developing container which has a plurality of conveyance chambers including a first conveyance chamber and a second conveyance chamber arranged parallel to each other, and a communication portion through which the first conveyance chamber and the second conveyance chamber communicate with each other at both end portions thereof in a longitudinal direction thereof, the developing container containing two-component developer comprising carrier and toner;

a first stirring-conveyance member which stirs and conveys developer existing in the first conveyance chamber in an axial direction of a rotation shaft thereof;

a second stirring-conveyance member which stirs and conveys developer existing in the second conveyance chamber in a direction opposite to the direction in which the first stirring-conveyance member conveys developer;

a developer carrier which is rotatably supported on the developing container, and carries on a surface thereof developer from the first conveyance chamber or from the second conveyance chamber;

a toner concentration sensor which is disposed on an inner wall surface of the second conveyance chamber, and detects a toner concentration in developer; and a scraper which is flexible and attached to the second stirring-conveyance member, and cleans a detection surface of the toner concentration sensor with a free end thereof by rotating with the second stirring-conveyance member, wherein the second stirring-conveyance member has a rotation shaft which is rotatably supported inside the developing container;

a first spiral blade which is formed on an outer circumferential surface of the rotation shaft, and conveys developer in an axial direction of the rotation shaft when the rotation shaft rotates;

a second spiral blade which is formed on the outer circumferential surface of the rotation shaft so as to overlap a region in which the first spiral blade is formed, the second spiral blade being opposite to the first spiral blade in phase and lower than the first spiral blade in height in a radial direction;

an absent region which is formed in one pitch of the first spiral blade, the one pitch facing the toner concentration sensor, and in which the second spiral blade does not exist; and a scraper attachment unit which is formed to extend, along a straight line passing through intersection points of the first spiral blade and the second spiral blade and parallel to the rotation shaft, into the absent region, the scraper being fixed to the scraper attachment unit, and the scraper attachment unit comprises an attachment member which is provided to project in the radial direction from the outer circumferential surface of the rotation shaft, a base end portion of the scraper being to be fixed to the attachment member, and a first support member and a second support member which are provided to project from the outer circumferential surface of the rotation shaft, each facing one of both end portions of the attachment member in the axial direction, so as for the scraper to engage in a gap between the attachment member and the first support member and a gap between the attachment member and the second support member.

4. The developing device of claim 3, wherein the first support member and the second support member are disposed to face a downstream-side surface of the attachment member with respect to a rotation direction of the second stirring-conveyance member.

5. The developing device of claim 3, wherein a clearance is formed between the first support member and an upper end portion of the first spiral blade and between the second support member and the upper end portion of the first spiral blade.

6. The developing device of claim 5, wherein the first support member and the second support member are respectively disposed on a downstream side and an upstream side with respect to the developer conveyance direction in the second conveyance chamber, the second support member having a trapezoidal shape in a side view such that a side thereof on the upstream side with respect to the developer conveyance direction in the second conveyance chamber is inclined toward the downstream side toward a leading end thereof.

* * * * *